United States Patent [19]

Eder

[11] Patent Number: 4,594,123

[45] Date of Patent: Jun. 10, 1986

[54] LABELING MACHINE FOR CONTAINERS

[75] Inventor: Erich Eder, Donaustauf, Fed. Rep. of Germany

[73] Assignee: Krones AG Hermann Kronseder Maschinenfabrik, Neutraubling, Fed. Rep. of Germany

[21] Appl. No.: 685,305

[22] Filed: Dec. 24, 1984

[51] Int. Cl.[4] ..... B65C 9/04; B65C 9/10

[52] U.S. Cl. ..... 156/456; 156/564; 156/567; 156/568; 156/571; 156/578; 156/DIG. 26; 156/DIG. 29; 156/DIG. 32; 156/DIG. 42

[58] Field of Search ..... 156/447, 456, 564, 567, 156/568, 571, 578, DIG. 26, DIG. 29, DIG. 32, DIG. 42

[56] References Cited

U.S. PATENT DOCUMENTS

| | | | |
|---|---|---|---|
| 4,092,207 | 5/1978 | Zudrow | 156/568 |
| 4,414,056 | 11/1983 | Buchholz et al. | 156/568 |
| 4,443,289 | 4/1984 | Kölges et al. | 156/568 |

FOREIGN PATENT DOCUMENTS

| | | | |
|---|---|---|---|
| 3102950 | 1/1982 | Fed. Rep. of Germany | 156/568 |

*Primary Examiner*—Michael Wityshyn
*Attorney, Agent, or Firm*—Fuller, House & Hohenfeldt

[57] ABSTRACT

A container labeling machine for applying one or the other of normal length body labels or extra-length boy labels has a rotating rotary table with container supporting controllable rotary plates. Adjacent its periphery is arranged a first labeling station for applying the normal length labels with a rotating labeling cylinder and a second labeling station for the extra-length labels with a stationary label container contacting the path of rotation of the containers. Two independent drives are provided for rotating the plates, one of which regulates the positioning and/or rotation of the rotary plates in the area of the first labeling station, and the second for continuous rotation of the rotary plates in the area of the second labeling station. The rotary plates are selectively connectible with the first or second drive. The two labeling stations and their common brush-on station overlap one another, whereby a very short total treatment stretch is possible. In addition, a simple changeover of the second drive is possible for the adaptation to different container diameters.

7 Claims, 4 Drawing Figures

LABELING MACHINE FOR CONTAINERS

BACKGROUND OF THE INVENTION

This invention relates to a machine for applying to containers, such as bottles, normal length labels, such as body labels, and extra-length labels, such as those which completely encircle the containers.

Labeling machines that have two labeling stations for applying labels of different sizes or labels at different locations on containers are known. Each station has an element for applying glue to the labels, a magazine from which labels are withdrawn and transferred to the container and an element for brushing over the label to press it onto the container. The containers are conveyed to a rotary table which moves them through a circular path. Each container goes onto a rotary plate which is driven to rotate the container about its vertical axis at appropriate times as it proceeds in a circular path. In prior art machines, the containers on the rotary plates first pass the encircling or extra-length labeling station to the brush-on element at which they are rotated continually then they pass to the normal or short-length labeling station and its brush-on element where the containers stand still relative to the rotary table and complete a 90 degree oscillation between the gripper cylinder that grips a label from the magazine and the brush-on station. This known labeling machine provides for applying normal length labels or extra-length labels without substantial change-over work. However, because the elements that perform the various operations with the labels are arranged in series around the rotational path of the rotary table and the stations themselves are arranged in series around the table in non-overlapping relationship. It becomes necessary to use a rotary table whose diameter is greater than a designer would like it to be. A consequence is that the machine base must be larger and this undesirably increases the cost of the machine. Moreover, in prior art machines that apply labels of different sizes to containers, when it is desired to changeover to treating bottles of different diameters the drive mechanisms or the rotating plates that support the containers along their circular path must also be changed in many respects. One reason for this is that for the extra length labels that encircle the containers, the labels are taken directly from a magazine by attachment to a coating of glue that was previously applied to the containers in which case the change in peripheral speeds of the containers having different diameters must be accounted for.

SUMMARY OF THE INVENTION

The primary object of the present invention is to provide a labeling machine wherein operations carried out in one station in which labels of one size are applied overlap, in a sense, the elements that perform operations in the station where labels of different sizes are to be applied.

In the new labeling machine described herein, the operational intervals of the normal length labeling station including its brush-on station as well as the extra-length or encircling labeling station and its brush-on stations are nested in one another or overlapping and the rotary plate drive mechanisms are easily adapted to the rotary plate movement required for the particular labeling. Thus, a substantial shortening of the distance along the rotary table at which both labeling applications take place is achieved.

An additional feature of the invention is that the mechanism that controls rotation of the container supporting plates for the long or encircling label application operations is especially adapted to make change-over for different container diameters simple. The user thereby has the capability of selecting the container support plate rotating mechanism that is most suitable for the size of the containers and the labels.

It is not necessary that the effective areas of the two rotary plate drives completely overlap with respect to the circular path of the rotary plates. The first drive for applying the normal or shorter length labels is, according to one feature of the invention, effective over the entire circular path. The mechanism for applying the longer length or encircling labels can be effective over a substantially lesser part of the circular path of the rotary plates.

For selective connection of the rotary plates, two drive schemes are available. In one case a positive shifting coupling or clutch is provided between the rotary plate and its underlying driving member. This makes it possible to avoid removal or replacement of parts when it is desired to adapt the machine for applying labels of one type or another only.

In another adaptation, when it is desired to change over from extra-length encircling labeling to short or normal length labeling and vice versa, the adaptation can be made easily because the plates that support the containers for rotation have lugs that mate with a carrier plate that has recesses to effect interlocking. This makes it possible to exchange rotary plates and obtain automatic coupling to the correct drive.

A further feature of the invention is that use of the two independent or separate drives for the rotating container support plates makes it possible to use a common brush-on station for pressing the different sized labels onto the containers.

In accordance with the invention advantages are obtained by having the containers encounter the labeling station for applying the normal or short labels first and the station for applying the extra-length container encircling labels next. This makes it possible for the labeling station for the extra long encircling labels to be fully integrated in the treatment zone for the normal length labels which is normally somewhat longer than the treatment zone required for a fully encircling label. This also makes it possible to install a labeling station for normal length labels such as back labels after the encircling label applying station has been passed by the containers.

The manner in which the foregoing features and other novel features of the machine are achieved will be evident in the ensuing description of a preferred embodiment of the invention which will now be set forth in reference to the drawings.

DESCRIPTION OF A PREFERRED EMBODIMENT

The labeling machine shown in FIGS. 1–4 is adapted to selectively apply to cylindrical bottles 1 extra-length container encircling labels 2 or normal length or non-encircling body labels 3.

Figure 1:
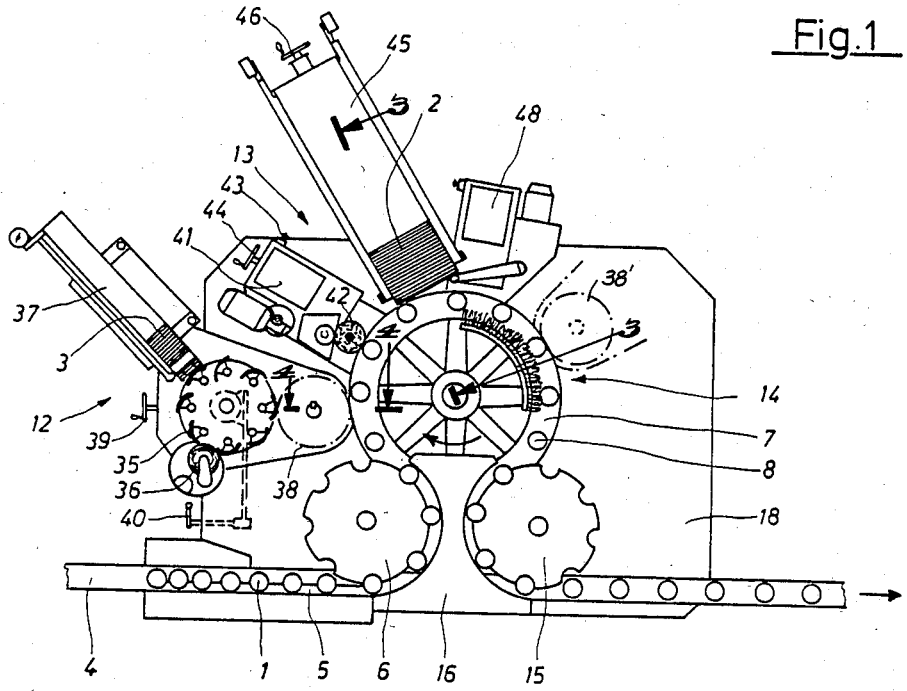
FIG. 1 is a plan view of the new labeling machine in which the upper part of the table that rotates the containers in a circular path is omitted.
Figure 3:
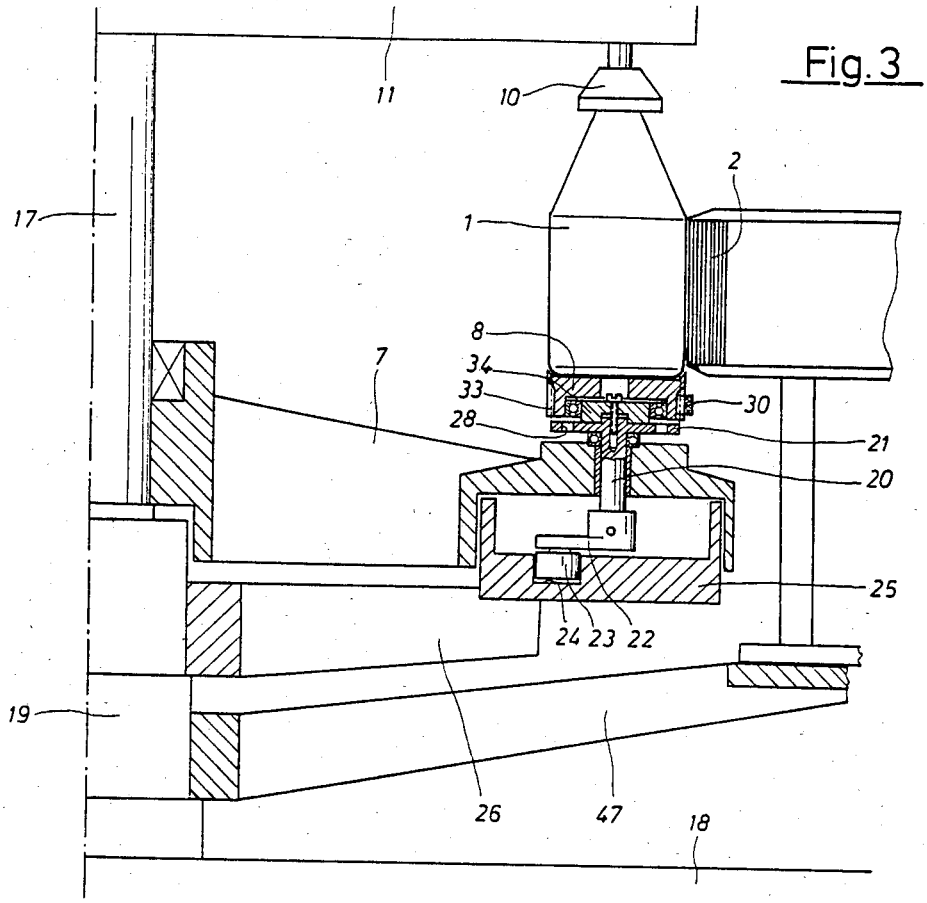
FIG. 3 is a vertical section taken on the line corresponding to 3—3 in FIG. 1 which constitutes part of the station for applying extra long labels to the containers.

In FIG. 1, a series of bottles 1 are advanced by means of a conveyor belt 4 to an inlet worm 5 which guides the bottles to an inlet star wheel 6 and then to a rotary table 7 rotating in the direction indicated by an arrow. In one operating mode, the bottles are supported on rotary plate means 8 as in FIG. 3 and in another mode on rotary plate means 9 as in FIG. 4. As shown in FIG. 3, in either case the bottles 1 are engaged at their tops by automatically vertically reciprocable bells 10 which stabilize the bottles on their supporting rotary plates as the bottles follow a circular path defined by rotary table 7. The bottles are engaged by bells 10 at the time they are transferred from inlet star wheel 6 to the rotary table 7 and they are disengaged at the time they are transferred to the outlet star wheel 15 for continued transport on the conveyor belt. The bottle stabilizing bells 10, of course, rotate with the bottles 1 as the latter are supported on either type of rotary plate means 8 or 9. The station that is activated for applying normal length non-encircling labels is designated generally by the numeral 12. The station for applying the extra-length or encircling labels is designated generally by 13. After passing the first and second labeling stations 12 and 13 and after having their labels applied, the bottles pass brush 14 which presses the label securely onto the bottles. In the region of the inlet star wheel 6 and the outlet star wheel 15, the bottles 1 stands on slide-plates, not shown, and are guided in a stable fashion by means of a guide member 16.

Figure 4:
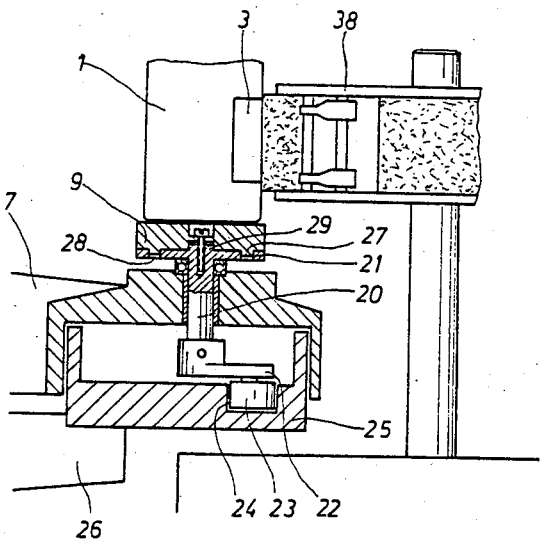
FIG. 4 is a fragmentary vertical section taken along the line 4—4 in FIG. 1.

Rotary table 7 is basically a spoked wheel with a U-shaped rim open toward its bottom as can be seen in FIGS. 3 and 4. The wheel is supported on a collar or flange 19 which is fixed on the machine housing 18 and the wheel may be driven by means of a motor, not shown, at different rotational rates. In any case, rotary table 7 is driven synchronously with the inlet worm 5, the inlet star wheel 6 and the outlet star wheel 15.

Figure 2:
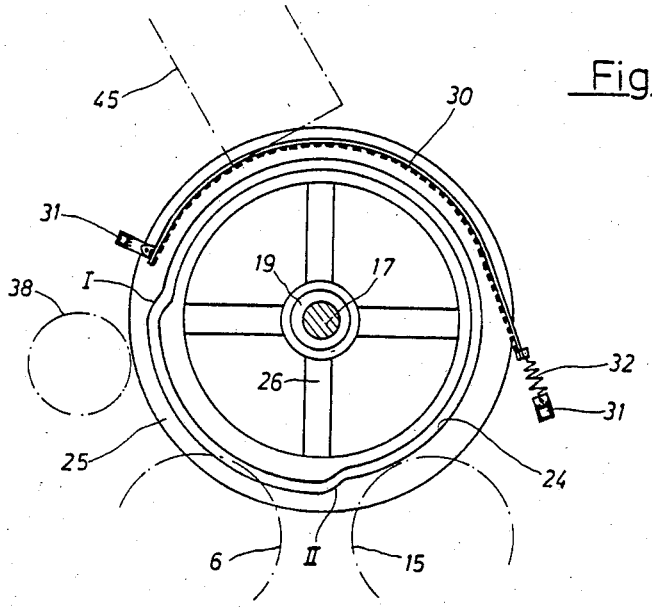
FIG. 2 is a plan view of a cam member and a stationary toothed belt which, in combination, provide for driving the rotary container supporting plates in two different modes.

Several vertical shafts 20 are journaled for rotation in the rim of rotary table 7. Shafts 20 are equiangularily spaced about the circumference of the rim. A circular or disk-shaped plate carrier 21 is fastened to the upper ends of shafts 20 in the FIG. 3 arrangement and the FIG. 4 arrangement as well. A lever 22 is fixed on the lower end of each shaft and the lever has a cam follower roller 23 which registers in a stationary cam groove 24. As can be seen in FIGS. 2–4, cam groove 24 is formed in a stationary cam ring 25. The cam groove is continuous around the entire circular path of the rotary container support plates 8 and 9. The stationary cam ring 25 lies under the open bottom of the wheel rim of the rotary table 7 and is fixed by means of several supporting arms 26 on the flange or collar 19.

In accordance with the invention, there are two schemes for rotating the bottle supporting plate means 8 or 9 depending on whether the machine is set up for applying extra-length or normal length labels. For applying the normal length labels, rotational movements of the bottles on rotary plates 9 results exclusively from a first shaft drive system comprised of the levers 22 and cam rollers 23 cooperating with cam groove 24. This situation is depicted in FIG. 4. Here the stationary cam groove cooperating with the cam followers rotates the bottle supporting plates 9 as required over the entire revolution or circular path of the rotary table 7. The cam groove 24 can be designed to provide the most varied relative positions and relative movements of the bottles as are necessary in the application of normal length labels such body or belly labels, back-labels, breast-labels, neck-ring labels and foil blanks for bottle neck jackets. Continuous rotation of the bottle supporting plates by more than 360 degrees is not possible using the first drive mechanism comprised of levers 22, cam follower rollers 23 and the cam groove 24 even if there is a gear system interposed between the shafts 20 and levers 22. Thus, when the normal length front labels are being applied, complete rotation of the bottles is not necessary and all angular positioning of the bottles on their supporting plates as they go around on the table is governed by the cam groove 24 reacting with the cam followers 23 and levers 22. The cam groove 24 has, in proximity with the first labeling station 12, a first transition area I through which the bottles 1 are rotated 90 degrees in such manner that the labels face forward or radially outward as they leave station 12. The bottles pass through the brush-on station 14 in this position. After the bottles have their labels pressed on by the brush 14, they are transferred to outlet star wheel 15. Continuous rotation of the table carries the now empty bottom supporting plate means and its cam roller into a second transition area II in the region between inlet star wheel 6 and outlet star wheel 15 where the bottle supporting rotary plates are again rotated back by 90 degrees. Thus, the simple form of cam groove 24 shown in FIG. 2 permits control over the bottles for an operation where normal length or non-encircling labels are being applied.

In the case where the bottles are having normal length labels applied their positions and oscillations are governed by cam groove 24. For this mode of operation, each rotary plate carrier 21 has a circular disk shaped rotary plate 9 fastened to it by means of a screw as shown in FIG. 4. Each rotary plate 9 is provided on its bottom side with at least a pair of projecting lugs 27 which register in corresponding holes 28 in rotary plate carrier 21. This arrangement provides a positive driving connection between the rotary plate carriers 21 and rotary plates 9. On the upper side of each rotary plate carrier 21 there is a centering lug 29 integral with plate carrier 21 which registers in a corresponding centering bore in the rotary plate 9. From the description thus far, it will be evident that for applying the shorter or normal length labels it is only necessary to rotate the bottles through a limited angle such as 90 degrees to effect application of the label and positioning of it for having the brush operate on it.

A full 360 degree revolution is required for securing the extra long or encircling labels on the bottles. As shown in FIG. 2, a toothed belt 30 is arranged adjacent the circular path followed by the bottle supporting plates for the extra long label application operation. Belt 30 is anchored at opposite ends 31 and a spring is interposed between the belt and one of the anchors to allow for enlarging the radius of the curved belt and allow for setting up the machine for handling different sized bottles. Stationary toothed belt 30 is capable of driving support plate means 8 in FIG. 3 rotationally through 360 degrees for the extra long label application operation. Plate or disk 10 is provided with an integral or an attachable set of peripheral gear teeth 34 which mesh with toothed belt 30 as they pass the latter. Toothed belt 30 together with gears 33 comprise a second drive means for the rotary plates which must be effective only in the area of the second labeling station 13 and the following brush-on station 14. The effective area of the first drive mechanism comprised of members 22, 23 and 24 completely surrounds the second drive scheme 30–33. Through the second drive, the bottles 1 are set in a multiple continuous rotation so that the bottles, on which glue has been previously applied, will pick up a label 2 by adhesion and rotate it properly for passing over the brush 14 to secure the label. The rotational speed of the bottles is accordingly regulated by the choice of the diameter of the gears 33 and is designed in such manner that the surface peripheral speed of a bottle is equal to zero relative to a point outside of the rotating table so that the latter can be set exactly on the leading edge of a label 2 in the stationary label magazine. In the case where the bottles 1 have encircling labels 2 applied, automatic continuous rotation is achieved by substituting for the rotary plates 9 as in FIG. 4 the rotary plates 8 as in FIG. 3. Rotary plate 8 in FIG. 3 is secured to the rotary plated carrier 21 by means of a center screw as can be seen by inspection of FIG. 3. Each second rotary plate 8 has a circular bearing support for a roller bearing that is concentric with the axis of rotation of the disk-shaped rotary carrier 21. Bearing body 34 is fixed by means of the screw on rotary plate carrier 21 and, hence, does not follow the oscillating movement caused by the groove cam 24 on follower 23, the lever 22 and shaft 20. In other words, the first drive scheme is inactivated. Now when the rotary plates 8, particularly their gears 33, pass through the region of station 13, the gears engage the toothed belt 30 and the rotary plates 8 and the bottle supported on them are set in continuous rotation over the length of the belt. There is no slippage because the centering lug 29 engages in a centering bore in the bearing body 34 and these two components are clamped tightly together by the center screw.

The first labeling station 12 for the body or non-encircling labels 3 includes a rotating cylinder on which there are several curved pallets 35 which are driven oscillatingly. As the cylinder rotates, one after another of the pallets rocks on a glue applicator roller 36 where it becomes coated with glue, and then on the leading label in a stationary label magazine 37 where a label becomes adhered to the pallet and then to a gripper cylinder 38 which takes the label off of the pallet and rotates the pallet around to the place where it can apply the label to the bottle. This is a label coating, pick up and transferring procedure which is used in many prior art labeling machines. The bottles are not rotating when the labels are first applied. The transfer from the pallets to the bottles takes place while the rotary plate 9 is prevented from rotating by reason of its cam roller 23 in FIG. 4 being in the shorter radius part of the cam groove which extends over most of the circumferential length of the cam groove 24. In the area II, the bottles are rotated 90 degrees so their labels face substantially radially outwardly. In this positions the bottles travel through the brush-on station 14 where the labels are pressed on tightly. The first labeling station 12 has a hand wheel 39 for offsetting the entire assembly radially relative to rotary table 7. A coupling disengager 40 allows for separation of the mechanism from the main drive of the labeling machine. The transfer or gripper cylinder 38 may also be removed from its drive shaft to inactivate the first station 12.

The second labeling station 13 where the encircling extra-length labels 2 are applied is provided with a glue application device 41 that includes a glue roller 42 making tangential contact with the rotational path of the bottles 1. A vertical strip of glue is applied to the bottles as they pass. The gluing device 41 has an independent drive motor, not shown, which is manually controllable by means of switch 43. The gluing device 41 is radially adjustable relative to the rotary table 7 by means of a hand wheel 44 and it is adjustable and securable in its circumferential direction. The second labeling station 13 also has a stationary label container or magazine 45 which is radially adjustable with a hand wheel 46 relative to rotary table 7. The container 45 for the extra long labels is supported by a bracket 47, see FIG. 3, which is adjustably clamped tightly to the flange 19. The label container 45 is positioned in such an attitude that the glue coated area on the bottle makes first contact with the leading edge of the foremost label in the container. Thus, the stripe of glue on the bottle effects partial adhesion of the label to the bottle. The trailing edge of the label is spaced somewhat from the path of rotation of the bottles 1. After a label is picked up it passes another glue applicator device 48 with which the trailing label edge is provided with a vertical strip of glue. The bottles are rotating counterclockwise along with their rotary plate 8 as they pass the label container. Thus, the labels are taken from container 45 by the first strip of glue and the label is wound on a bottle until the last removed label edge adheres to the bottle. Subsequently, the labels are pressed on tightly in the brush-on station 14 and smoothed during continuous rotation of the bottles. Because the bottles rotate rapidly and for at least a full revolution as they pass the brush, the spacing of the bottles along the rotary table may be just as small as is allowed for applying the non-encircling body labels 3. For the application of encircling labels 2 as in FIGS. 1, 2 and 3 the gluing device 41 is so adjusted that the glue roller 42 contacts the rotational path of the bottles at a suitable point. Also, the label container 45 is disposed in such manner that the foremost label contacts the path of rotation of the bottles 1 at the right point. When the rotary plates are mounted to the rotary plate carriers 21 as in FIG. 3, plates corresponding with the diameters of the bottles are selected. As explained, the toothed belt is anchored at 31. The brush 14 is one having the proper radius of curvature for both effectively pressing the labels onto the bottles. As explained, when the FIG. 3 mode of operation is in effect, the first labeling station 12 is inactivated by means of using the shifting coupling 40 and its gripper cylinder 38 is removed. In the alternative, it may also be moved away by means of hand wheel 39 from the bottle table 7. Both gluing devices 41 and 48 are activated for applying the extra-length labels as previously described.

Now for a changeover to bottles having another diameter on which encircling are to be applied, the usual adjustment of the gluing devices 41 and 48 are made and the label container 45 position is adjusted. The only substitution of parts is the second rotary plates 8 which are exchanged for the rotary plates that were appropriate for the diameter of the bottle in the last labeling run. The replacement rotary plates 8 have geared teeth 33 whose pitch diameter mates with the outer diameter of the bottles. The tension spring 32 which connects to the toothed belt 30 accommodates the gears of various diameters by elastic deformation to assume the shape of a polygon instead of the smooth curve of the belt as in FIG. 2. To change over the machine for applying normal size body labels 3 the following operations are required. The first labeling station 12 is activated by means of the shiftable coupling 40 and the label gripper or transfer cylinder 38 is slipped onto its drive shaft or, if the cylinder has not been removed, the entire labeling station 12 can be suitably driven generally radially inwardly of the rotating table 7 by means of hand wheel 44. The gluing device 41 for the encircling labels is retracted from the rotary table by means of hand wheel 44 and/or the glue roller 42 is removed from its drive shaft. The label container 45 is retracted from rotary table 7 by means of hand wheel 46 or the label container can be simply removed as an entity from its mounting. The brush-on station 14 is supplemented with a further brush-on strip on the outer side of the path of revolution of the bottles. The alternate rotary plates 8 are removed from rotary plate carriers 21 and replaced by rotary plates 9 so that the bottles 1 will execute the movements and positions determined by the cam groove 30. The toothed belt 30 may remain in the machine if desired but unnecessary wear can be prevented by removing it from its mounting.

As indicated earlier, the gear teeth may be formed integrally with rotary plates 8 or ring gears having an inside diameter that is complementary to the diameter of the plates and has a different pitch diameter may be used to avoid the need for exchanging the entire rotary plates 8 to obtain different size wheels 33 that are required for the different size bottles.

The machine is not restricted to applying labels of only two different sizes to bottles. It is possible to arrange another labeling station similar to first labeling station 12 subsequent to labeling station 13 in the direction of table 7 rotation. The additional labeling station with transfer cylinder 38' is represented by phantom lines may be used for applying back-labels. The additional labeling station can be installed if the rotary table 7 has sufficient diameter and, hence, sufficient circumferential space to fit in the additional station. If for application of body labels, the glue roller 42 is retracted and the label container 45 is removed, then the brush-on station 14 may be lengthened to extend more closely to the second labeling station 13 up to the gripper cylinder 38 so that even complicated labelings as, for example, applying tin foil to the necks of the bottles becomes possible.

I claim:

1. A machine for applying to containers such as bottles a selected one of normal length labels that do not encircle the containers (non-encircling labels) or extra-length labels that encircle the containers (encircling labels), said machine comprising:

a rotary table driven rotationally for transporting containers in a circular path, a plurality of rotary plate means for supporting transported containers and arranged in circumferentially spaced apart relationship on said table in said circular path and means supporting said plate means, respectively, on said table for rotating about axes parallel to the rotational axis of said table, one station including means arrangeable adjacent said path selectively operable to apply non-encircling labels to said containers and another station including means arrangeable adjacent said path selectively operable to apply encircling labels, said one station including a first holder for non-encircling labels, means for picking up a label from said first holder and means for depositing a glue coated label on a passing container, said other station including a second holder for encircling labels, means for applying glue to said containers for a passing container to pick up a label from said second holder, first and second drive means connectible alternately to said rotary plate means, said first drive means being operative to rotate said plate means and containers thereon through suitable angles of rotation for securing said non-encircling labels on the containers and said second drive means being operative to rotate said plate and containers thereon through suitable angles of rotation for securing said encircling labels on said containers.

2. The machine according to claim 1 wherein said first drive means comprises a stationary closed cam element arranged about said circular path and a plurality of cam follower means engaged with said cam element and coupled to the rotary plate means, respectively, and said second drive means comprises a stationary toothed member extending along part of said circular path and gear means on said rotary plate means, respectively, for meshing with said toothed member during part of a table revolution to thereby rotate said containers on which glue has been applied for picking up an encircling label from said second container and continuing rotation for at least one full revolution of the plate means and containers, and means for pressing against said encircling labels at least until the end of the full revolution.

3. The machine according to claim 1 wherein:

said first drive means comprises a plurality of shafts journaled for rotation on said table and supporting said plate means, a cam follower fixed on each shaft, and a closed loop cam element arranged around said path and engaged by all followers to effect rotation of said shafts, said second drive means comprising a stationary toothed drive member extending along a part of said circular path, first and second alternatively usable types of container supporting plates comprising said plate means, the first type of plate having means for coupling them to said shafts, respectively, for being driven rotationally by said first drive means, the second type of plate means having means for mounting them for rotation on said shafts and having a circular array of gear teeth that mesh with said tooth drive member periodically as said table rotates to thereby rotate said plate means and containers thereon at least one full revolution.

4. The machine according to claim 1 wherein:

said plate means are comprised of a plate carrier each supported for said rotation of said table and operatively coupled to said first drive means, said plate means further comprising exchangeable types of container supporting plate members, one type of plate members having means for fastening them to said plate carriers for being driven rotationally by said first drive means and another type of plate member having means for mounting them rotationally on said plate carriers for being driven rotationally by said second drive means.

5. The machine according to claim 4 wherein said first drive means comprises a closed loop cam element arranged around said circular path and a plurality of cam followers engaged with said cam and connected in driving relationship with said carriers for rotating said carriers and the one type of plate members, said second drive means comprising a stationary toothed member extending along a part of said path, said other type of plate members including gear means engageable with said toothed member during part of a revolution by said table means to thereby rotate said other plate members relative to said carriers.

6. The machine according to any one of claims 1–5 wherein said one station for applying non-encircling labels is arranged in front of the other station for applying encircling labels, looking in the direction of rotation of said rotary table.

7. The machine according to claim 6 including a brush means located in the path of said containers in the vicinity of said second station for applying pressure on labels after they have been deposited on said containers at one or the other stations.

* * * * *